United States Patent [19]

Radek

[11] 4,442,630

[45] Apr. 17, 1984

[54] DOOR CONTROL

[75] Inventor: John R. Radek, Hinsdale, Ill.

[73] Assignee: Ready Metal Manufacturing Company, Chicago, Ill.

[21] Appl. No.: 349,711

[22] Filed: Feb. 18, 1982

Related U.S. Application Data

[63] Continuation-in-part of Ser. No. 78,095, Sep. 24, 1979, abandoned, and Ser. No. 179,961, Aug. 20, 1980, Pat. No. 4,411,102.

[51] Int. Cl.[3] ..... E05C 7/06

[52] U.S. Cl. ..... 49/115; 49/356; 49/104

[58] Field of Search ..... 49/113, 110, 111, 118, 49/252, 248–251, 344, 356, 115

[56] References Cited

U.S. PATENT DOCUMENTS

| | | | |
|---|---|---|---|
| 693,385 | 2/1902 | Faulds | 49/113 X |
| 2,330,005 | 9/1943 | Odenthal | 49/118 X |
| 2,501,897 | 3/1950 | Guimont | 49/113 X |
| 3,402,509 | 9/1968 | Haglund | 49/504 X |
| 4,286,411 | 9/1981 | Wikkerink et al. | 49/430 X |
| 4,322,912 | 4/1982 | Heinrich | 49/340 X |

*Primary Examiner*—Kenneth Downey

*Attorney, Agent, or Firm*—Frank H. Marks

[57] ABSTRACT

A Door Control designed especially for a service passage in a cubicle disposed, say, at or near the entrance of a quick food establishment or the like, i.e., for serving customers on one side of the passage by an employee on the other side. This application is in part a continuation of my copending applications Ser. Nos. 78,095 filed Sept. 24, 1979, now abandoned, and 179,961 filed Aug. 20, 1980, now U.S. Pat. No. 4,411,102, which disclose and claim mechanism for simultaneously opening a pair of doors mounted on vertical parallel axes. In both of said inventions the door opening mechanism is characterized by a horizontally translatable device, such as a pushrod, by an operator's muscular force applied below the service table, leaving the hands free. Upon release of such muscular force, the doors are automatically returned to their original closed positions by means of energy stored, as in a spring, in the opening action. The present invention further contemplates an improvement in said prior inventions by applying automatic actuating means such as an electrical motor and other elements to the door actuating mechanisms of my prior inventions, and possibly to other mechanisms accomplishing the same purpose.

14 Claims, 9 Drawing Figures

DOOR CONTROL

This application is in part a continuation of my copending applications Ser. Nos. 78,095, filed Sept. 24, 1979, now abandoned and 179,961 filed Aug. 20, 1980, now U.S. Pat. No. 4,411,102, which disclose and claim door controls and, more particularly, means for actuating a service door in a fast food dispensing establishment or the like.

BACKGROUND

I am aware that the prior art shows various means for simultaneously actuating a pair of swinging doors, including a variety of mechanisms for opening and closing them. The art I consider pertinent is exemplified in the citations of record in my copending applications noted above.

Each of said copending applications discloses a mechanism characterized by a pushrod disposed below a service table or shelf across which is passed currency, merchandise, etc., which pushrod is designed to be actuated by muscular effort of an operator seated behind the table, say, by a knee, leaving the hands free. Said pushrod transmits motion through a certain mechanism to a pair of swinging doors, causing them to rotate pivotally on vertical axes, providing clear access across said table for transaction of business. Upon release of such muscular force the doors are automatically returned to their original closed positions by reverse movement of said mechanism actuated by a spring or the like.

BRIEF OUTLINE OF INVENTION

Disclosed herein is an improvement in the inventions of said copending applications described above, whereby the need for muscular force is obviated, the door opening and closing mechanism being actuated entirely by automatic means motivated, say, by an electrical motor controlled by the operator behind the table.

In general, operation of the door actuating mechanism according to my new improvement may be initiated by a slight movement of the operator's body, i.e., the torso, without use of the hands, whereupon she may relax and attend to her business of dispensing merchandise, accepting currency, etc. Upon completion of the transaction, the doors may be closed by a similar movement of the operator's torso. A master or control switch is also provided to energize the electrical circuit preparatory to operation of the doors.

Various other objects and advantages will become apparent to those skilled in the art as the description proceeds.

BRIEF DESCRIPTION OF DRAWINGS

Referring now to the drawings forming part of this specification and illustrating certain preferred embodiments of my invention.

DETAILED DESCRIPTION

Figure 1:
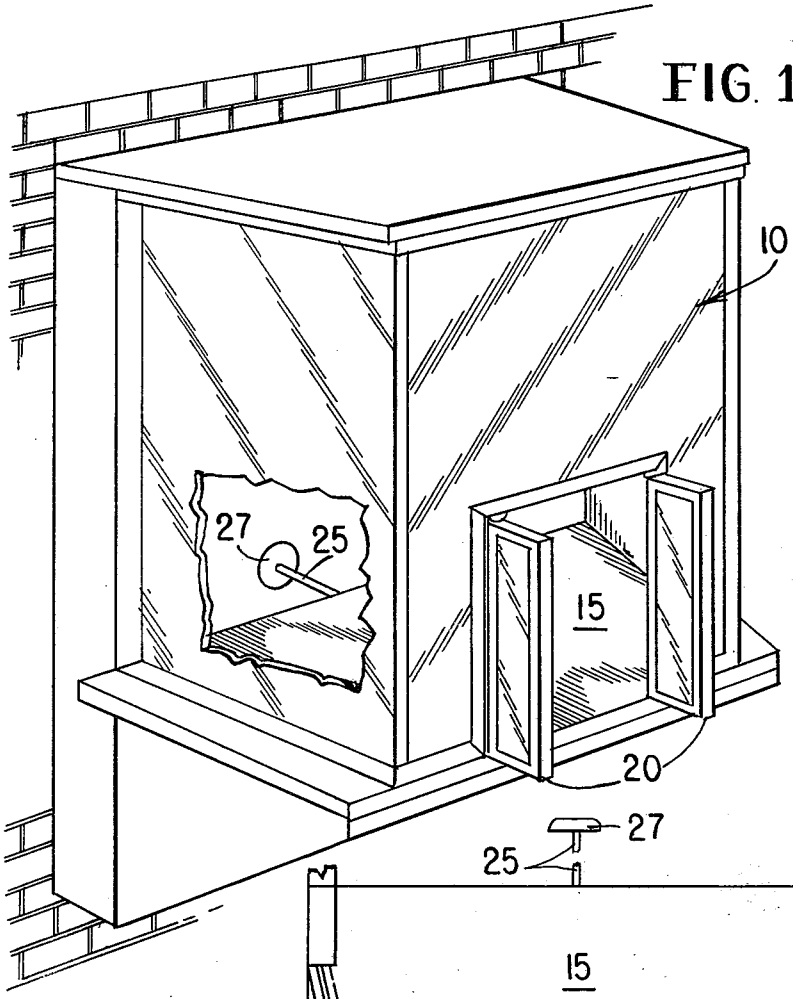
FIG. 1 is a front perspective view of a cubicle at or near the entrance of a fast food establishment or the like, with doors embodying my invention shown in open position, as in my copending application Ser. No. 78,095, now abandoned.
Figure 2:
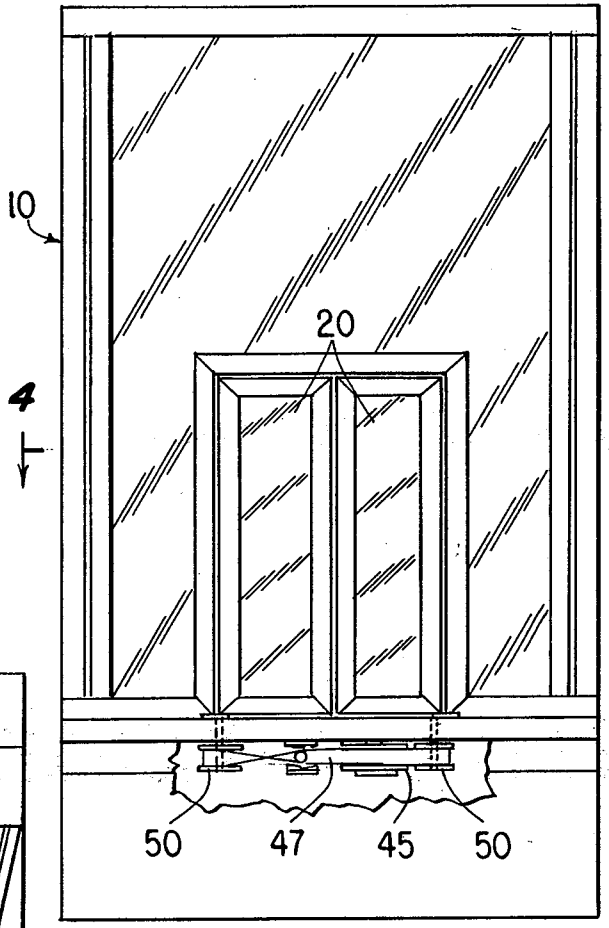
FIG. 2 is a front elevation of same with the doors closed.
Figure 3:
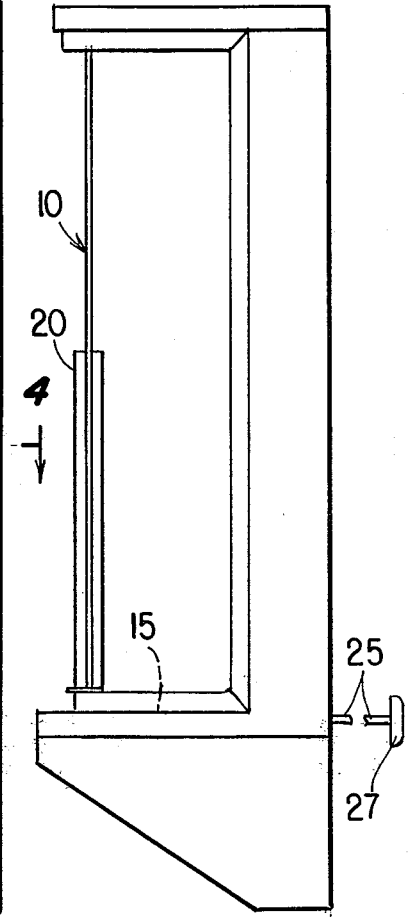
FIG. 3 is a side elevation of the arrangement of FIG. 2.
Figure 4:
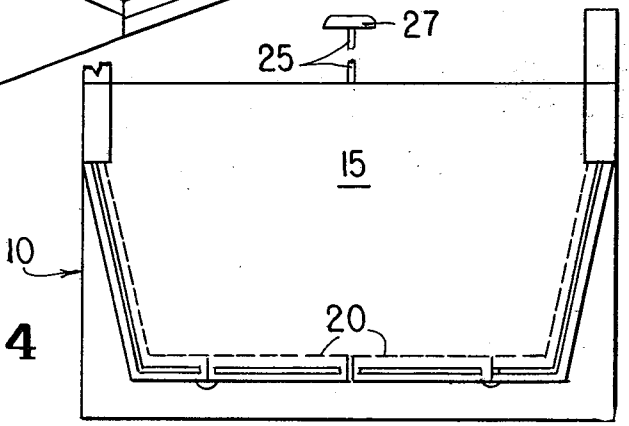
FIG. 4 is a plan-section substantially along line 4—4 of FIG. 2.

For convenience, I may hereinafter refer to the embodiment of my earlier-filed parent application by a characterizing feature, viz., cam-controlled, and the later-filed as bell crank-controlled.

Referring first to the embodiment of abandoned application Ser. No. 78,095, shown in FIGS. 1–8, inclusive, hereof, in this construction a cam transmits motion through a flexible coupling to a door or pair of doors, the cam being actuated by muscular force of an operation, applied as by a knee or thigh below the service table, through a pushrod or like straight-line element, leaving the operator's hands free. Power is stored from the opening operation, as in a spring, which acts to close the doors on removal of muscular power.

Numeral 10 (FIGS. 1–4) designates a cubicle that might be positioned, say, at the front of a fast food establishment where "carry out" orders are usually placed for rapid execution.

The cubicle may have transparent walls in whole or in part in order to provide visibility between a customer on the outside and an employee on the inside of the cubicle. At the base of the cubicle is a shelf or ledge 15 adjacent the front or customer's side of which a passage is provided for transaction of business. Said passage is provided with closure means that might be a single or double door. Preferably, a pair of doors 20, 20 is provided, designed to swing on vertical hinges or pivots.

My invention is particularly concerned with means for opening and closing doors 20, which normally remain closed and are opened by the employee inside the cubicle for transaction of business through the aforesaid passage.

A door actuating device 25 is disposed below shelf 15, which device may comprise a retractable plunger rod or the like operable by linear force applied to plunger head 27 at the free end of the rod, by movement of a part of the employee's body, say a knee or thigh, leaving the hands free for other purposes.

Forward axial movement of the plunger acts to open doors 20 through transmission mechanism comprising a crank 30 (FIG. 5) pivoted as at 32 below shelf 15 and having on its free arm 35 a cam track 37. A cam follower 40 in the form of an anti-friction roller carried by plunger rod 25 rides in cam track 37.

Pivot 32 about which said crank 30 rotates is provided by a stub shaft keyed to the crank and to a toothed sprocket wheel 45 actuating a flexible coupling such as a toothed belt 47. The latter is wound around sheaves 50, 50 rotation of which by belt 47 serves to swing doors 20 on their pivots through suitable links 46

Figure 7:
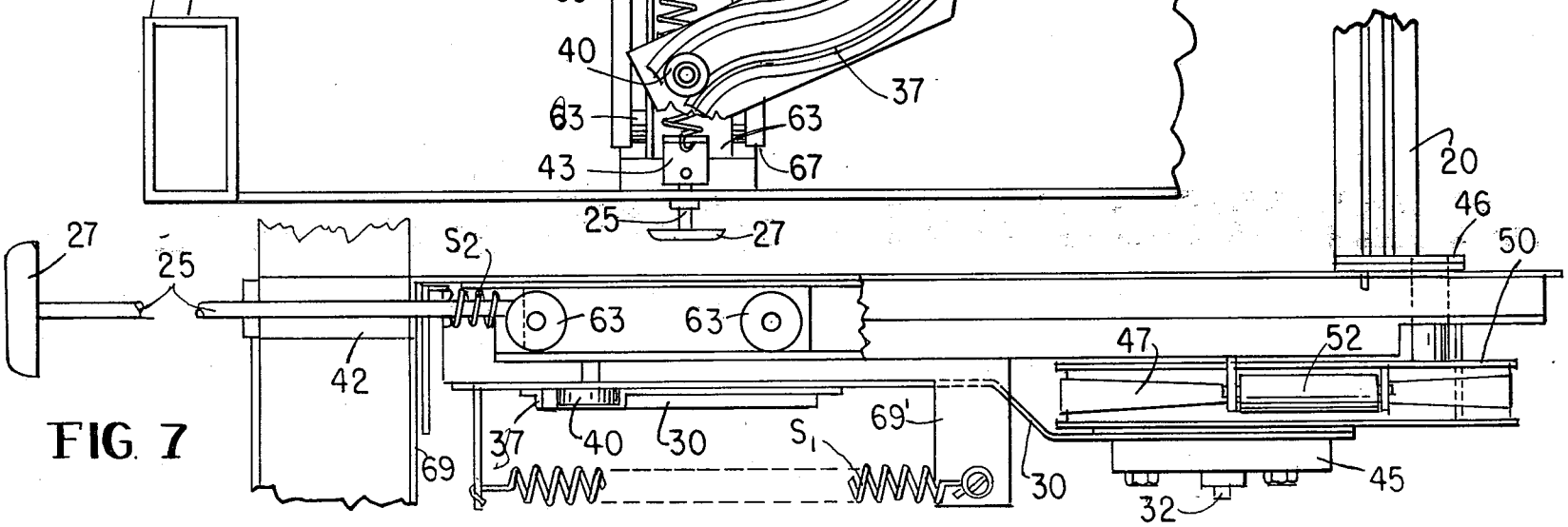
FIG. 7 is a fragmentary elevation of the control mechanism of this embodiment with the doors closed.
Figure 7A:
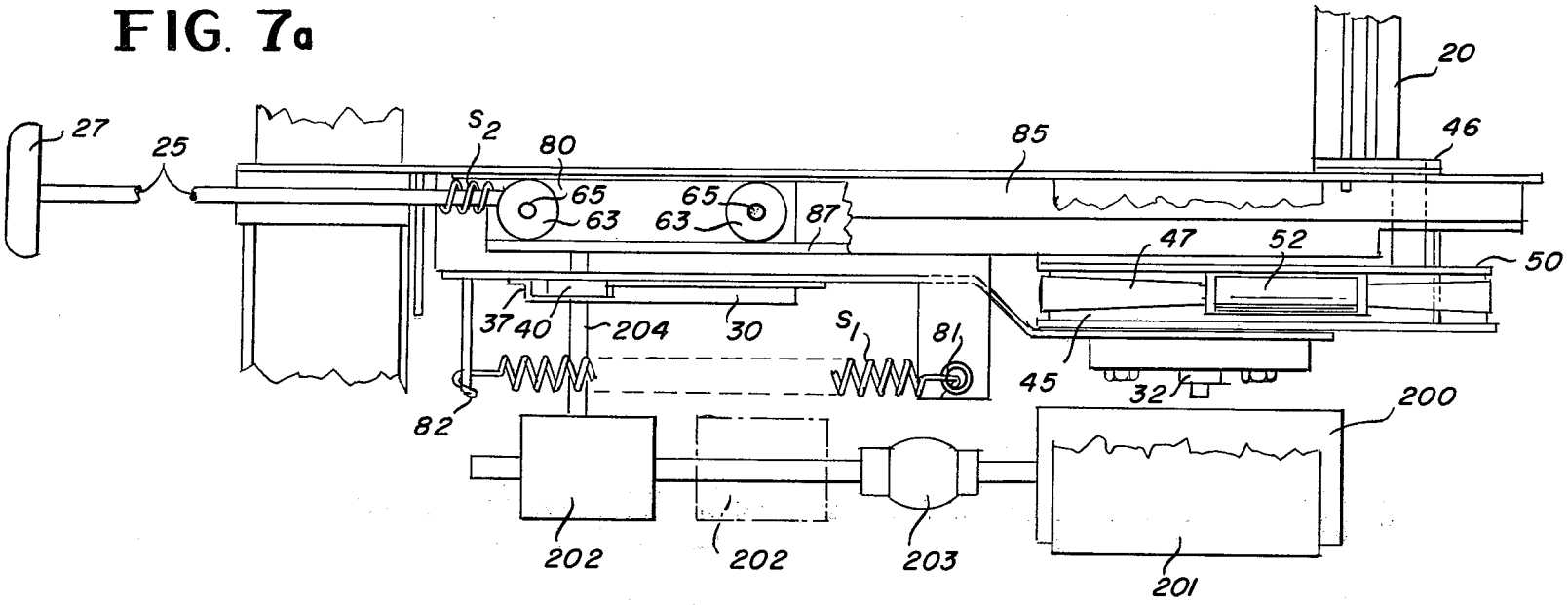
FIG. 7*a* is a fragmentary elevation generally similar to FIG. 7 but modified to provide for electrical control in lieu of muscular control.

(FIG. 7). An idler cylinder 52 is provided to maintain separation between adjacent runs of belt 47.

Figure 5:
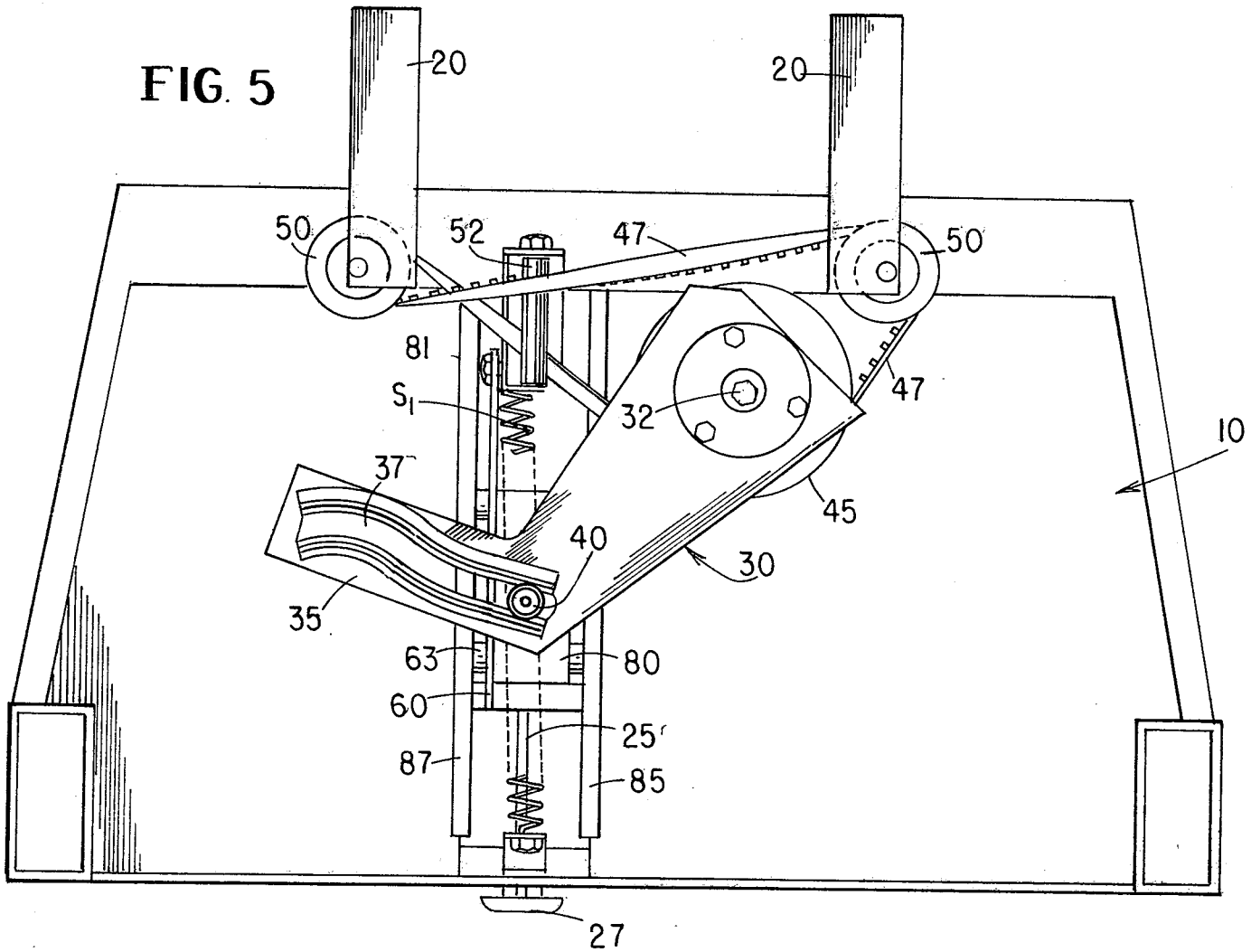
FIG. 5 is a plan view of the control mechanism of this embodiment with the doors open.
Figure 6:
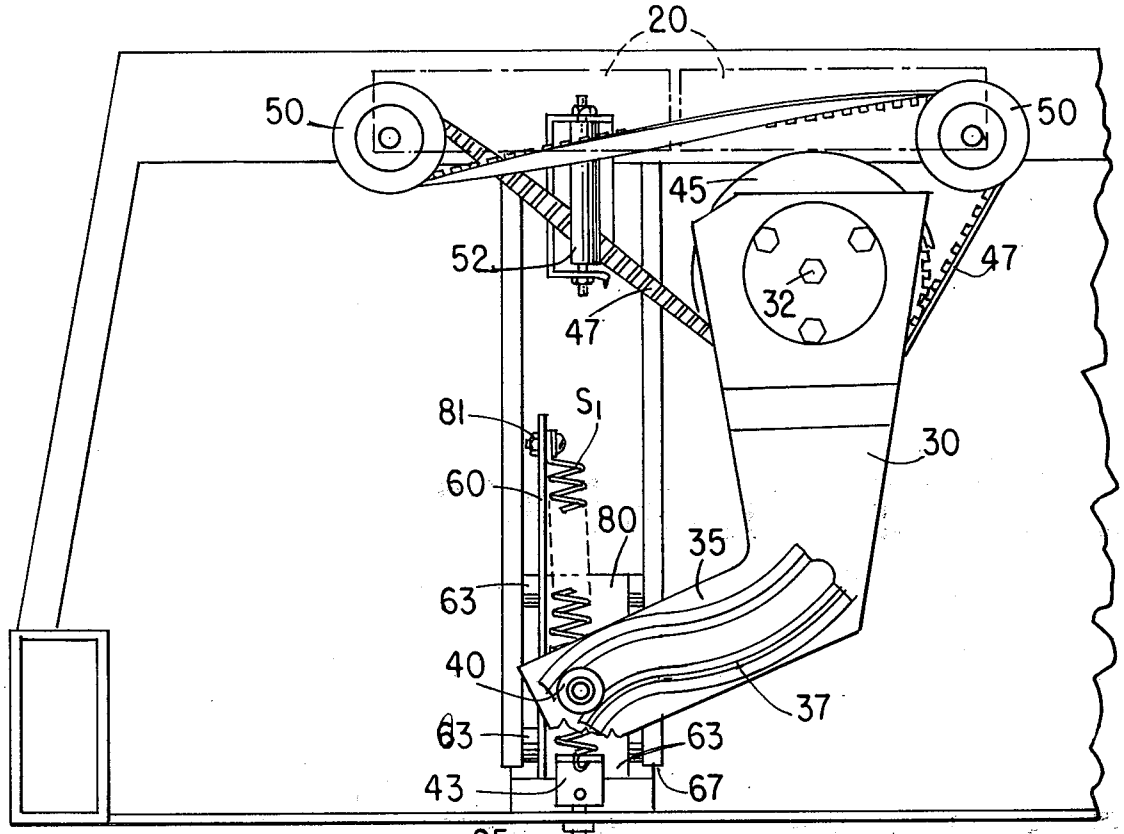
FIG. 6 is a view similar to FIG. 5 with the doors closed.

Thus, rotation of wheel 45 clockwise by the cam and crank conveys force through belt 47 to swing doors 20 on their pivots from closed position (FIGS. 2–4, 6) to open position (FIGS. 1, 5).

Figure 8:
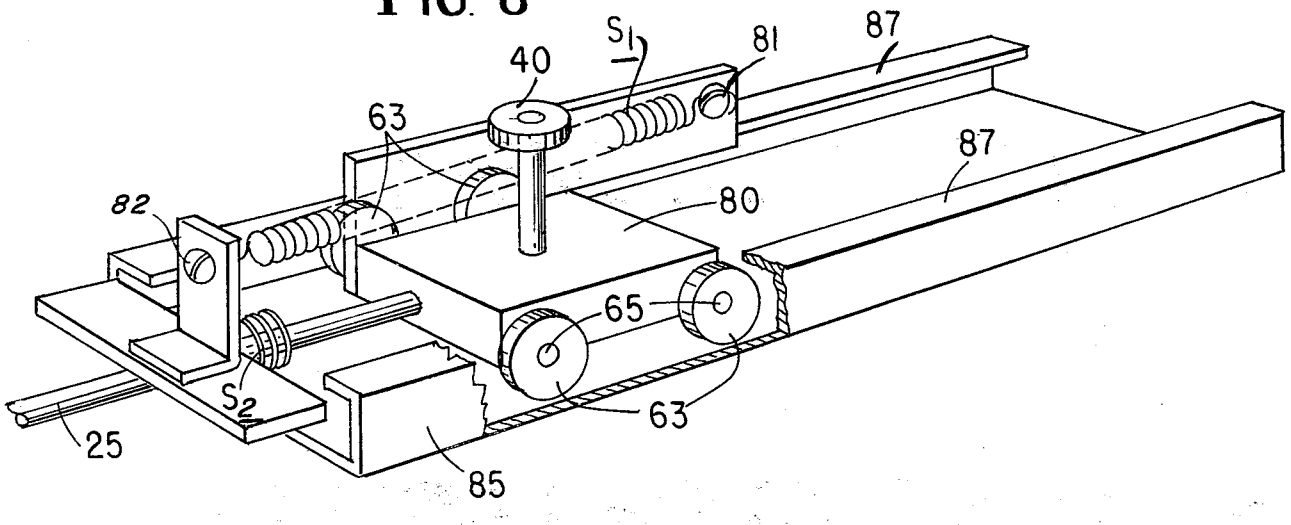
FIG. 8 is a fragmentary perspective obverse view of the carriage elements of the control mechanism which is common to both embodiments shown in FIGS. 7 and 7*a*.

To convey motion from pushrod 25 to the cam, cam follower 40 is mounted in a carriage 80 arranged to slide reciprocally within a channel member 85 fixedly mounted under shelf 15. Marginal flanges 87, 87 on channel 85 slidably engage roller bearings 63 on shafts 65 carried by carriage 80. (FIG. 8.)

As cam follower 40 is moved forward by plunger 25, it moves carriage 80 slidably within channel 85, rollers 63 sliding with a minimum of friction in engagement with flanges 87 of said channel to render nearly effortless the muscular action required to open the doors.

To carriage 80 is attached as at 81 a tension spring $S_1$ secured under the shelf as at 82, said spring being extended as plunger 25 and carriage 80 are moved forwardly to open the doors against resistance of said spring.

Upon release of muscular pressure against the plunger, spring $S_1$ reacts to restore the parts to their original positions, rotating the crank clockwise through the cam, closing the doors.

A compression spring $S_2$ on plunger shaft 25 behind carriage 80 serves to cushion return movement thereof when pressure is removed from plunger 25 and the carriage and parts actuated thereby automatically return to normal position.

NON-MUSCULAR CONTROL

As noted hereabove, my invention contemplates actuation of the doors by electrical means, leaving the operator entirely free to concentrate on transaction of business across the counter.

It should be understood that such electrical means is applicable not only to the cam and bell crank arrangements described herein but also to various other possible mechanical constructions.

FIG. *7a* shows a door control mechanism similar to that shown in FIG. 7, with the additional capability of its operation by electric motive means. For this purpose, a reversible electric gear motor 200 is supported in bracket 201 for operating an actuator 202 connected to the motor by coupling 203. The actuator 202 is connected by means of vertical shaft 204 to the cam follower 40 in engagement with cam track 37. The energization of the motor moves actuator 202 in the position shown in dotted lines, which results in the movement of follower 40 and the carriage 80 in which it is mounted, to open the doors, as described above.

The subsequent energization of gear motor 200 effects a reverse movement of the actuator to its position shown in full lines and the consequent movement of the carriage and follower 40 to close the doors.

The electric motor 200 is a reversible gear motor well known in the industrial arts and may be the Model R.F.S. Split Capacitor motor, manufactured by Merkle-Korff Industries, Inc., 1776 S. Winthrop Drive, Des Plaines, Ill. 60018.

The arrangement shown in FIG. *7a* is adapted to operate the windows either by human muscular force initiated by pressing the plunger 27, or automatically by electric force upon energization of the motor 200. If only automatic actuation is desired, the plunger in FIG. *7a*, together with the return spring 51, may be omitted, so that the movement of the carriage may be executed by successive energizations of the motor 200.

CONCLUSION

It will be seen that I have disclosed a simple mechanism for opening and closing a door or pair of doors mounted to swing on a vertical axis or pair of parallel axes, by means of a simple straight-line force applied below a counter by an operator, leaving the hands free for transaction of business across the counter. In lieu of muscular force, the operation may be accomplished automatically through electrical energy, utilizing essentially the same or other generally similar mechanical means.

Various other changes or modifications coming within the spirit of my invention may suggest themselves to those skilled in the art. Hence, I do not wish to be limited to the specific forms shown or uses mentioned except to the extent indicated by the appended claims.

I claim:

1. In combination with an inclosure having a passage therein and a pair of swinging doors closing said passage, said doors having opposed vertical hinges and substantially meeting edges when closed, and means for simultaneously opening and closing said doors comprising, a. straight line reciprocable means actuable by human muscular force to open the doors,
b. a fixed member carried by the inclosure and slidably mounting said reciprocable means,
c. a cam follower carried by said reciprocable means,
d. a crank arm pivoted at one end and having a cam at the opposite end in engagement with said cam follower,
e. mechanical transmission means extending between said pivoted end of said crank arm and said doors for opening the latter, and
f. energy storing means operable automatically to close the doors when force is withdrawn from the reciprocable means.

2. A combination as in claim 1, wherein the means for transmitting motion from the crank arm to the doors includes a flexible coupling extending therebetween.

3. A combination as in claim 2, wherein the means for automatically closing the doors comprises a helical spring associated with the reciprocable means.

4. An apparatus as in claim 1, wherein said mechanical transmission means comprises pulley means mounted on the pivoted end of said crank arm, a rotary pulley connected to the lower end of the vertical hinge of each door, and flexible coupling means interconnecting the rotary pulleys to impart rotary motion from said pulley means to the rotary pulleys and the doors controlled thereby.

5. An apparatus as in claim 4, wherein said energy storing means comprising a spring connected to said reciprocable means for actuating said crank arm in the reverse direction upon release of said muscular force.

6. A combination as in claim 1, wherein a. said fixed member comprises a channel-like member having lateral flanges,
b. anti-friction means slidably mounting the reciprocable means relative to said flanges, and
c. said energy storing means comprises a resilient member coacting between the reciprocable means and a fixed part of the inclosure.

7. In combination with an inclosure having a passage therein and a pair of swinging doors closing said passage, said doors having opposed vertical hinges and substantially meeting edges when closed, and means for simultaneously opening and closing said doors comprising, a. straight line reciprocable means to open the doors,
b. a fixed member carried by the inclosure and slidably mounting said reciprocable means,
c. a cam follower carried by said reciprocable means,
d. a crank arm pivoted at one end and having a cam at the opposite end in engagement with said cam follower,
e. mechanical transmission means extending between said pivoted end of said crank arm and said doors for opening the latter, and
f. means operable automatically to close the doors.

8. A combination as in claim 7, wherein the means for transmitting motion from the crank arm to the doors includes a flexible coupling extending therebetween.

9. A combination as in claim 8, wherein the means for automatically closing the doors comprises a helical spring associated with the reciprocable means.

10. An apparatus as in claim 7, wherein said mechanical transmission means comprises pulley means mounted on the pivoted end of said crank arm, a rotary pulley connected to the lower end of the vertical hinge of each door, and flexible coupling means interconnecting the rotary pulleys to impart rotary motion from said pulley means to the rotary pulleys and the doors controlled thereby.

11. An apparatus as in claim 9, wherein said spring is connected to said reciprocable means for actuating said crank arm in the reverse direction.

12. A combination as in claim 7, wherein a. said fixed member comprises a channel-like member having lateral flanges,
b. anti-friction means slidably mounting the reciprocable means relative to said flanges, and
c. said last-mentioned means comprises a resilient member coacting between the reciprocable means and a fixed part of the inclosure.

13. An apparatus as set forth in clam 7, wherein said straight line reciprocable means is provided with a free end adapted to be actuated by human muscular force.

14. An apparatus as set forth in claim 7, including electric motor means for operating said straight line reciprocable means.

* * * * *